US006213891B1

(12) United States Patent
Moore

(10) Patent No.: US 6,213,891 B1
(45) **Date of Patent: *Apr. 10, 2001**

(54) GOLF CLUB GRIP AND METHOD OF PUTTING

(75) Inventor: Simon Garry Moore, P.O. Box 799 18 Bronte Place, Cambridge (NZ)

(73) Assignee: Simon Garry Moore, Cambridge (NZ)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/216,980

(22) Filed: Dec. 21, 1998

(30) Foreign Application Priority Data

May 8, 1998 (WO) ..... PCT/NZ98/00056

(51) Int. Cl.[7] ..... A63B 53/14
(52) U.S. Cl. ..... 473/300; 473/313
(58) Field of Search ..... 473/316–323, 473/300–303, 313, 340–341, 294, 293

(56) References Cited

U.S. PATENT DOCUMENTS

| | | | | |
|---|---|---|---|---|
| 2,107,983 | * | 2/1938 | Hamilton | 473/296 |
| 3,219,348 | * | 11/1965 | Dishner | 473/204 |
| 3,679,207 | * | 7/1972 | Florian | 473/294 |
| 3,712,343 | * | 1/1973 | Sparks | 138/177 |
| 3,837,647 | * | 9/1974 | Jacques | 473/300 |
| 4,067,573 | * | 1/1978 | Key | 473/300 |
| 4,426,083 | * | 1/1984 | Dishner | 473/294 |
| 5,253,868 | * | 10/1993 | Baumann | 473/312 |
| 5,452,891 | * | 9/1995 | Thomas . | |
| 5,454,564 | * | 10/1995 | Kronogard . | |
| 5,779,559 | * | 7/1998 | Eberle | 473/300 |

* cited by examiner

*Primary Examiner*—Jeanette Chapman
*Assistant Examiner*—Stephen L. Blau

(57) ABSTRACT

A long putter with a single long putter grip, greater than 35 cm in length, where the grip may have a reverse taper an be circular or non circular in cross section, and may be grasped with an inter-woven finger gripping technique. The putter may be used in a simple pendulum type putting stroke, with minimal wrist flexure. With this method of putting the top of the putter makes contact with the sternum depression, thereby stabilizing the top of the putter against the body, and both hands grasp the lower portion of the grip, the hands being in direct or indirect contact with each other. To strike the ball, the golfer rotates the triangular unit of arms and shoulders, together with the putter, about an axis point which would be near his/her spinal column, and behind his/her sternum depression.

4 Claims, 3 Drawing Sheets

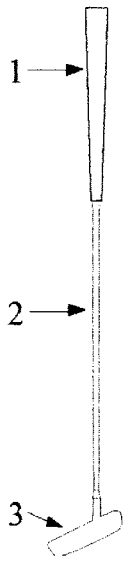
FIG. 1
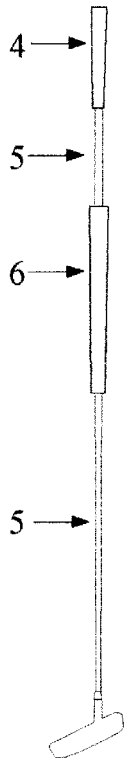
FIG. 3
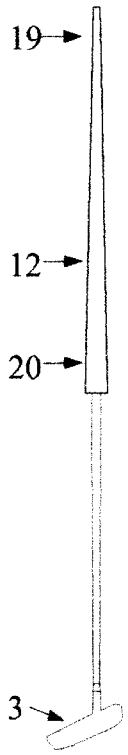
FIG. 6
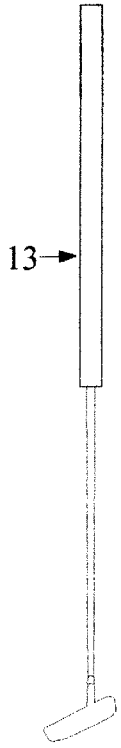
FIG. 7
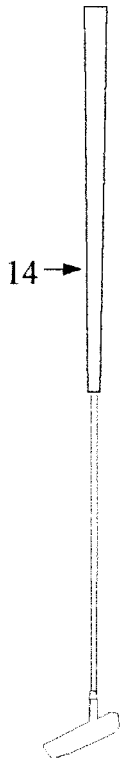
FIG.8
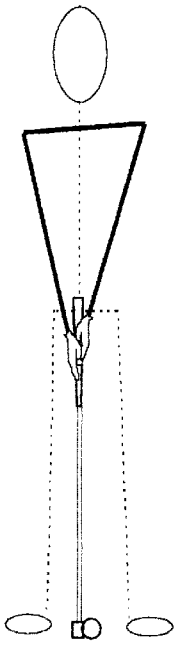
FIG. 2
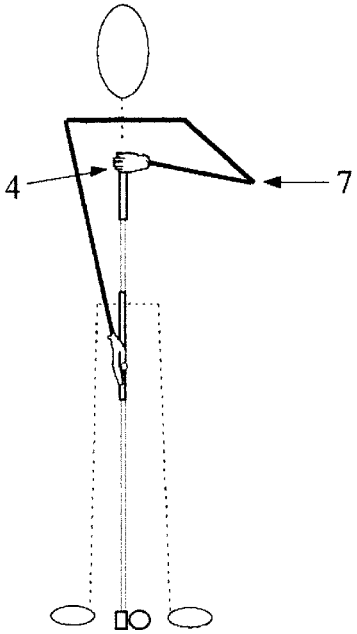
FIG.4
FIG. 5
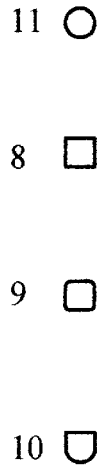

GOLF CLUB GRIP AND METHOD OF PUTTING

BACKGROUND OF THE INVENTION

Golf has become a popular recreational game. In the game of golf a ball is played from the teeing ground to the putting green by successive strokes, and once on the putting green into the hole, using a specialized club called a putter.

A conventional short putter (FIG. 1) is between 75 and 90 cm. in total length, and has a single grip 1, located at the top end of the shaft 2. The player grasps the single grip with both hands (FIG. 2) when putting the ball with the putter head 3.

While the use of a putter is an apparently simple action, it is perhaps the part of golf which is least reliable from day to day. A common problem that golfers experience when putting is excessive wrist flexure, or hinging of the wrists, when swinging their putter, which contributes to inconsistency of both direction and distance control.

An extreme form of poor putting is a condition known as the yips, whereby the golfer has greatly excessive wrist flexure in his/her stroke, sometimes accompanied by excessive body movement as well. It has been known for golfers suffering from the putting yips to occasionally even miss the ball completely.

Many famous golfers, including Sam Snead, Ben Hogan, Bernhard Langer, and Tom Watson have had periods of very unreliable short distance putting, using conventional short putters.

To improve their putting some golfers are no longer using a conventional short putter, and are now using a long putter (FIG. 3) in a simple pendulum type putting action.

A long putter is between 100 and 130 cm. in total length, and has two grips, an upper grip 4, located at the top end of the shaft 5, and a lower grip 6, below it on the shaft. An alternative form of long putter available has a single non tapered grip (FIG. 7). Other forms possible include long grips with taper (FIGS. 6/8). The player grasps the upper grip with one hand when putting the ball, and this upper hand is stabilized against the body, usually the chest (FIG. 4), or chin, and remains relatively stationary during the putting stroke. The other hand grips the lower grip 6, providing the force to hit the ball, and the putter is pivoted with this lower hand from a pivot point in the approximate area of the upper hand.

A disadvantage of this method is that it is quite different to conventional short putter technique and requires considerable practice to re-establish the golfer's confidence in his/her new putting technique.

A second disadvantage is that only the one hand, the lower hand, is involved in applying force to the putt and this makes it harder to reliably control the path of the club.

A third disadvantage is that the very unusual looking split-hand gripping method, which has the hands some 40 to 60 cm. apart, and one elbow raised up 7, draws attention, embarrassing the golfer and signifies to many observers that the golfer has had trouble with short putts, a condition known as the yips.

Almost all conventional short putters have a non-circular section grip, some of which 8, 9, 10 are illustrated in FIG. 5. This indicates the very strong preference by golfers for non-circular cross section putter grips. However long putters, having two grips, must use grips of only circular cross section (11 in FIG. 5). This is required by Rules of Golf (1996 edition, Appendix 2, 4-1c). This is a further disadvantage for golfers using the long putter. (In the 1996 Walt Disney Open, which is a regular United States Professional Golfer's Association Tour event, a golfer named Taylor Smith was the joint leader after the completion of 72 holes, but was then disqualified for using a non-conforming grip. Taylor Smith was using a long putter with two grips but one of them was non-circular and therefore in bread of the Rules of Golf).

Because of these four disadvantages less than 2% of golfers presently use a long putter.

A number of patents have dealt with improvements to putters and putting technique to enable better putting. Many of these have attempted to improve the design and use of long putters.

Parmley, 1965 (U.S. Pat. No. 3,188,086) describes a method of putting where the putter shaft extends above and beyond the end of the putter grip so that the shaft extension may connect with the abdomen via a pivot member on the end of the shaft. This enables the top of the putter to be stabilized against the abdomen, but the shaft extension is illegal for playing according to the Rules of Golf (Rule 4).

Bernhardt 1979 (U.S. Pat. No. 4,163,554) describes a method of putting using an elongated putter, with two gripping portions, and putting in a side saddle manner while facing the hole. The hand which holds the upper grip portion is stabilized against the body, and the putter is pivoted from this area. This method has been found cumbersome and difficult to use especially with longer putting distances.

Thomas, 1995 (U.S. Pat. No. 5,452,891) describes an extension device to convert a conventional short putter to the long putter twin grip form. However this device, being easily adjustable, is in breach of the Rules of Golf ($28^{th}$ Edition, 1996, Appendix 2, Rule 4-1a(i)).

Scheie et al. 1996 (U.S. Pat. No. 5,531,446) describes a putting training aid which is an elongated rod with a ball on one end. When inserted in the end of a putter the movement of the ball relative to the body identifies if there is excessive wrist flexure when swinging the putter. This training aid is illegal for play according to the Rules of Golf ($28^{th}$ Edition, 1996, Appendix 2, Rule 4-1a(i)). Also it does not seek to restrict wrist flexure but to identify it.

Present golf club grips are between 24 and 29 cm in length.

Present long putter technique uses a split grip method. An improvement on the present art would be a putter which, is legal for play, which may be circular in cross section or may be one of various types of non-circular grip section, and is adjustable to suit the golfer's stature and preferred posture, and is used in a way which is more like conventional putting technique, while restricting unwanted wrist flexure.

BRIEF SUMMARY OF THE INVENTION

A long putter, adjustable in length to suit the golfer's stature and preferred posture, with a single long putter grip, where the grip may have a reverse taper and/or be non circular in cross section, and may be grasped with an inter-woven finger gripping technique. The putter may be used in a simple pendulum type putting stroke, with minimal wrist flexure.

A method of putting where the top of the putter makes direct or indirect contact with the sternum depression, thereby stabilizing the top of the putter against the body. Indirect contact with the sternum depression is where the top of the putter is separated from the golfer's sternum depression by his/her clothing, and extending both arms comfortably to grasp the lower portion of the grip, the hands being in direct or indirect contact with each other. Indirect contact of the hands is where the hands are separated by a golf glove or thin cloth. A golfer may wear one or two gloves, two gloves shown in FIGS. 2, 4 and 11.

The putter may be used in a simple pendulum type putting stroke, with minimal wrist flexure, and may be grasped with an inter-woven finger gripping technique.

To strike the ball, the golfer rotates the triangular unit of arms and shoulders, together with the putter, about an axis point which would be, near his/her spinal column, and behind his/her sternum depression.

BRIEF DESCRIPTION OF SEVERAL VIEWS OF THE INVENTION

FIG. 1 is a conventional short putter with a short grip.

FIG. 2 shows the method of using a conventional short putter, grasping the single grip with both hands, while wearing golf gloves.

FIG. 3 is a long putter as currently available, with two spaced short grips.

FIG. 4 shows the method of using a long putter as currently available.

FIG. 5 shows some cross sections of putter grips.

FIG. 6 is a long putter with a single long grip, which tapers so that the cross section of the grip is greater towards the putter-head end.

FIG. 7 is a long putter with a single long grip, which has no taper.

FIG. 8 is a long putter with a single long grip, which tapers so that the cross section of the grip is greater towards the sternum end, when in use.

Figure 10A:
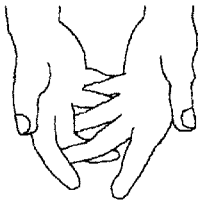
Figure 10B:
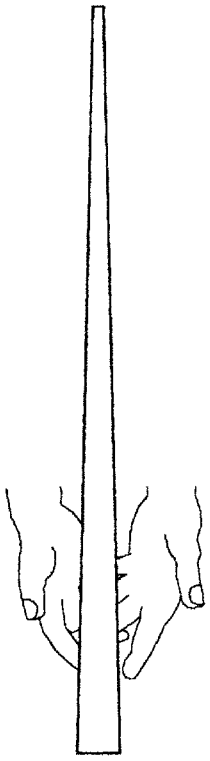

FIGS. 10A/B/C shows three steps in grasping the putter grip using the inter-woven fingers method.

Figure 11C:
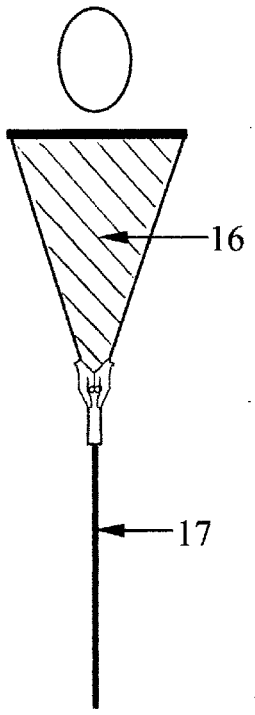
Figures 11A, 11B:
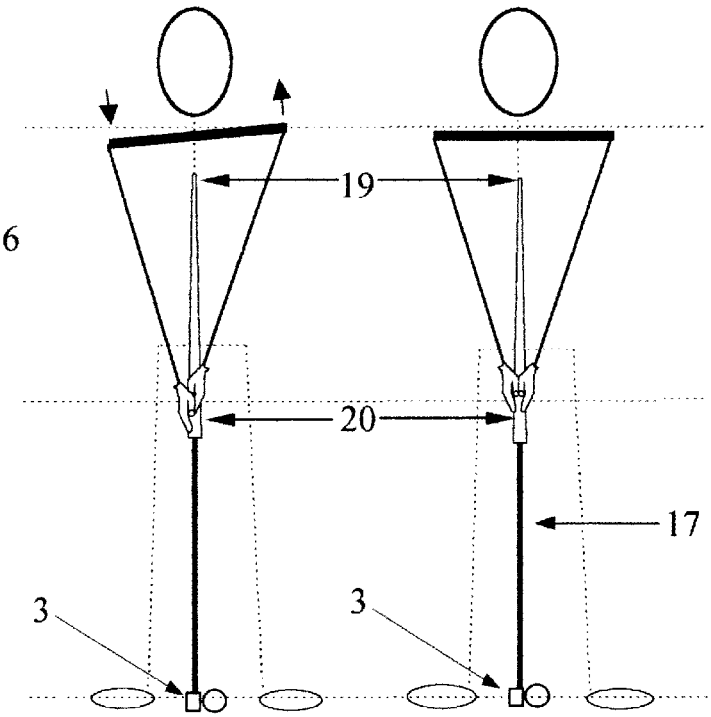
Figure 12A:
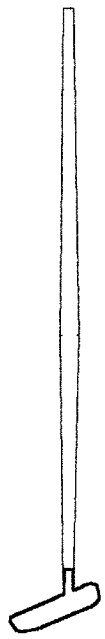
Figure 12B:
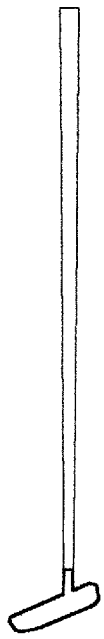
Figure 12C:
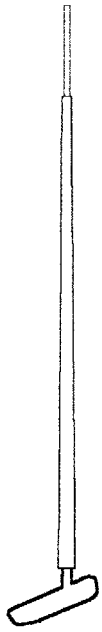

FIGS. 11A/B demonstrates the effect of hand position, on the tilt of the shoulders.

FIG. 11C shows the triangular unit of arms and shoulders.

DETAILED DESCRIPTION OF THE INVENTION

Figure 9:
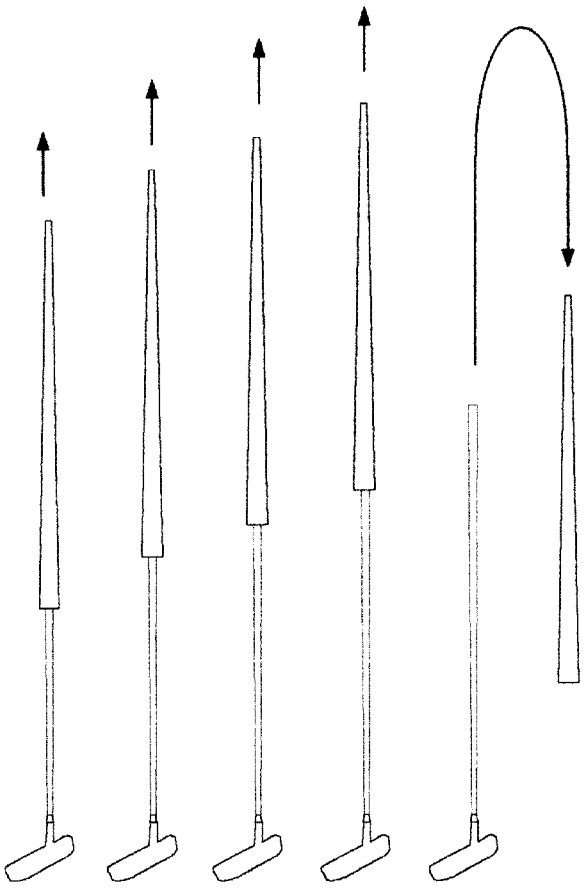
FIG. 9 shows that a grip may slide up and down the putter, and be used in a variety of positions, or indeed be removed completely.

This invention describes a putter (FIGS. 6/7/8) which is legal for play, having a single long grip 12, 13, 14, preferably of non-circular section, although it may be circular in cross section. This grip may be greater than 35 cm in length, may be re-positioned (FIG. 9) up and down the shaft, in a variety of positions, and secured in place to suit the golfer's stature and preferred posture.

This invention describes a putter which enables the golfer to stabilize the top of the putter by engaging it with his/her body. Various parts of the upper body when so engaged serve as a stabilization point, some of these being: the navel, the rib cage area of the chest, the sternum depression of the chest, or the armpit.

Having achieved this stabilization the putter grip may then be grasped in the normal two handed way with the golfer's hands, or preferably by inter-weaving his/her fingers about the grip as described below (FIGS. 10A/B/C). In either case the hands are in contact with each other, while grasping the grip, which is in marked contrast to how long putters are currently used (FIG. 4).

In this way the putter is stabilized by body contact, but may be grasped in a normal way otherwise, using a similar posture to normal.

This invention provides for a method of putting where the top of the putter makes contact with the sternum depression, directly or indirectly, thereby stabilizing the top of the putter against the body, and extending both arms comfortably to grasp the lower portion of the grip/grips, with the hands in contact with each other, directly or indirectly.

This invention describes a putting method which enables the golfer to stabilize the top of the putter 19 by engaging it with his/her body. Various parts of the upper body when so engaged may serve as a stabilization point, some of these being: the chin, the navel, the rib cage area of the chest (under the sternum bone), the armpit, and the sternum depression of the chest.

The sternum depression is the anatomical depression of the chest overlying the sternum bone. The sternum bone, or breast bone, runs from below the neck to above the stomach, and has ribs articulated with it. In an adult male the sternum depression is an approximately oval shaped area perhaps 16 cm high and 8 cm wide, with its center about 6 to 8 cm above the bottom of the sternum bone itself.

While each of these stabilization points has merit the sternum depression area is advantageous as the putter shaft will be pointing at the axis of rotation of the putter/arm unit.

With arms comfortably extended a strong triangle shape is formed by the arms and the horizontal line across the shoulders (FIGS. 11A/B). This triangular unit of arms and shoulders 16, (shaded in FIG. 11C), together with the putter shaft 17 extending from the apex of the triangular unit to the ball, is able to easily rotate about an axis point which would be near the spinal column and behind the sternum depression of the chest. This arrangement is advantageous as it facilitates a simple repeatable putting stroke, with minimal wrist flexure.

As the upper portion of the putter grip merely serves to make contact with the stabilization point, it does not need to be as thick as a normal putter grip, and to avoid excess weight it is advantageous for the grip to be narrower at the top 19. Therefore this invention describes a grip which has a reverse taper so that the grip's greatest diameter at it's lower end 20, nearer the putter head 3 (FIGS. 6 and 11B).

Figure 10C:
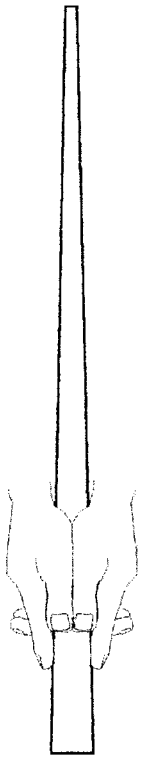

This invention provides for a grip technique where the fingers are inter-woven about the putter grip (FIGS. 10A/B/C). To grasp the putter the golfer first interweaves his/her fingers, left finger below right finger, or vice versa. Three fingers of each hand, (the small ring and middle fingers) alternate, so that when the putter is grasped each of these fingers of the left hand is separated form it's adjacent finger of the left hand by a finger of the right hand, and vice versa. The palms are then brought towards each other to securely hold the putter grip, with the thumbs generally on top of the grip and the fore fingers generally to the side of the grip (FIG. 10C).

The advantage of this grip technique is that both hands are close to the apex of the triangular unit of arms and shoulders described above. This makes the triangular unit even simpler and stronger. Also this grip technique allows the golfer to simply place the ball in the center of his/her stance and with the hands being extended the same distance down the putter grip, this allows his/her shoulder line to be parallel to the ground at address. With the shoulders parallel to the ground at address it is less likely the shoulders will be open at address, a common fault where the shoulder line points to the left of the target for a right handed golfer, and therefore it is more likely the shoulders will remain parallel to the target line at address. This arrangement improves the golfer's ability to aim correctly.

The preferred embodiment of this invention is a long putter, with a single long adjustable putter grip, where the grip has a reverse taper and is usually non circular in cross section.

The top of the putter is stabilized in the sternum depression and the arms comfortably extended to grasp the thicker lower portion of the grip by inter-weaving the fingers about the putter grip.

To strike the ball, the golfer rotates this triangular unit of arms and shoulders, together with the putter, about an axis point which would be near his/her spinal column and behind his/her sternum depression.

The preferred embodiment so described is a putter which is legal for play, adjustable to suit the golfer's stature and preferred posture, using a inter-woven finger gripping technique, and facilitates a simple repeatable putting stroke, with minimal wrist flexure.

The invention described has the advantage of being adjustable to a variety of gripping technique preferences and putting postures.

It enables the golfer to putt in a simple but effective way and not draw to much attention to this style.

The reverse taper grip reduces the volume of materials required, and therefore manufacturing cost, and also reduces weight, improving balance.

I claim:

1. A golf club grip, with a length greater than 35 cm, that has a greater cross sectional dimension in the region of it's lower end, for placement closest to a club head end of a shaft when attached to a shaft, than in the region of its upper end, for placement furthermost from a club head end of a shaft when attached to a shaft.

2. A golf club with a single grip, with a grip length of greater than 35 cm, where the grip has a reverse taper, so that it has a greater cross sectional dimension in the region of it's lower end, closest to the club head end, than in the region of its upper end, furthermost from the club head end.

3. A golf club grip, with a length greater than 35 cm, where the grip has a reverse taper so that it has a greater cross sectional dimension in the region of it's lower end, for placement closest to a club head end of a shaft when attached to a shaft, than in the region of its upper end, for placement furthermost from the club head end of a shaft when attached to a shaft.

4. A golf club with a single grip, with a grip length of greater than 35 cm, where the grip has a greater cross sectional dimension in the region of it's lower end, closest to the club head end, than in the region of its upper end, furthermost form the club head.

* * * * *